US010222081B2

(12) United States Patent
Iwasaki

(10) Patent No.: US 10,222,081 B2
(45) Date of Patent: Mar. 5, 2019

(54) AIR-CONDITIONING APPARATUS

(71) Applicant: Mitsubishi Electric Corporation, Tokyo (JP)

(72) Inventor: Kazuhisa Iwasaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 221 days.

(21) Appl. No.: 15/027,257

(22) PCT Filed: Jan. 21, 2014

(86) PCT No.: PCT/JP2014/051153

§ 371 (c)(1),
(2) Date: Apr. 5, 2016

(87) PCT Pub. No.: WO2015/111141

PCT Pub. Date: Jul. 30, 2015

(65) Prior Publication Data

US 2016/0245536 A1 Aug. 25, 2016

(51) Int. Cl.
*F24F 11/30* (2018.01)
*F24F 11/62* (2018.01)
(Continued)

(52) U.S. Cl.
CPC ..... *F24F 11/30* (2018.01); *F24F 11/62* (2018.01); *F25B 13/00* (2013.01); *F25B 43/006* (2013.01);
(Continued)

(58) Field of Classification Search
CPC ..... F24F 11/006; F24F 2011/0082; F25B 43/006; F25B 49/02; F25B 13/00; F25B 2400/04
See application file for complete search history.

(56) References Cited

U.S. PATENT DOCUMENTS 6,244,057 B1 * 6/2001 Yoshida ..... F25B 13/00 62/151
2009/0056358 A1 * 3/2009 Kotani ..... F24F 5/0017 62/259.1

FOREIGN PATENT DOCUMENTS

JP H0719629 A * 1/1995
JP 09-119736 A 5/1997
(Continued)

OTHER PUBLICATIONS

Nakamura et al., Air Conditioning Apparatus, Jan. 20, 1995, JPH0719629A, Whole Document.*
(Continued)

*Primary Examiner* — Larry Furdge
(74) *Attorney, Agent, or Firm* — Posz Law Group, PLC

(57) ABSTRACT

A controller is configured to decide whether liquid refrigerant is unevenly distributed among a plurality of outdoor units and then adjust an outlet subcooling degree of an outdoor heat exchanger or an outlet sub cooling degree at a high-pressure outlet of a high-low pressure heat exchanger, and a discharge superheating degree of a compressor in a low capacity-side outdoor unit to match lower heat exchange capacity of the outdoor heat exchanger in the low capacity-side outdoor unit with higher heat exchange capacity of an outdoor heat exchanger in a high capacity-side outdoor unit, the low capacity-side outdoor unit being one of the plurality of outdoor units in which the outdoor heat exchanger has the lower heat exchange capacity, the high capacity-side outdoor unit being another of the plurality of outdoor units in which the outdoor heat exchanger has the higher heat exchange capacity.

7 Claims, 4 Drawing Sheets

(51) Int. Cl.

| | |
|---|---|
| ***F25B 13/00*** | (2006.01) |
| ***F25B 49/02*** | (2006.01) |
| ***F25B 43/00*** | (2006.01) |

(52) U.S. Cl.

CPC ..... *F25B 49/02* (2013.01); *F25B 2313/006* (2013.01); *F25B 2313/0233* (2013.01); *F25B 2313/0253* (2013.01); *F25B 2313/02731* (2013.01); *F25B 2313/02741* (2013.01); *F25B 2313/0314* (2013.01); *F25B 2313/0315* (2013.01); *F25B 2400/04* (2013.01); *F25B 2400/05* (2013.01); *F25B 2400/075* (2013.01); *F25B 2400/13* (2013.01); *F25B 2600/0271* (2013.01); *F25B 2700/1931* (2013.01); *F25B 2700/1933* (2013.01); *F25B 2700/2101* (2013.01); *F25B 2700/21151* (2013.01); *F25B 2700/21152* (2013.01)

(56) References Cited

FOREIGN PATENT DOCUMENTS

| | | | |
|---|---|---|---|
| JP | 11-142010 | A | 5/1999 |
| JP | 2007-225264 | A | 9/2007 |
| JP | 2009-243761 | A | 10/2009 |
| JP | 2010-164219 | A | 1/2010 |
| JP | 2011-208928 | A | 10/2011 |

OTHER PUBLICATIONS

Extended European Search Report dated Sep. 14, 2017 issued in corresponding EP patent application No. 14880080.8.

International Search Report of the International Searching Authority dated Apr. 28, 2014 for the corresponding International application No. PCT/JP2014/051153 (and English translation).

* cited by examiner

AIR-CONDITIONING APPARATUS

CROSS REFERENCE TO RELATED APPLICATIONS

This application is a U.S. national stage application of International Application No. PCT/JP2014/051153 filed on Jan. 21, 2014, the disclosure of which is incorporated herein by reference.

TECHNICAL FIELD

The present invention relates to an air-conditioning apparatus including a plurality of outdoor units.

BACKGROUND ART

To meet demands for a larger capacity, air-conditioning apparatuses including a plurality of outdoor units and a plurality of indoor units have been developed, in which the outdoor units and the indoor units are connected via a common gas pipe and a common liquid pipe. In such an air-conditioning apparatus, uneven distribution correction control (liquid equalization and excessive refrigerant processing) is performed to control refrigerant distribution to each of the outdoor units, to thereby prevent the refrigerant from being unevenly distributed to the outdoor units (see, for example, Patent Literature 1).

CITATION LIST

Patent Literature

Patent Literature 1: Japanese Unexamined Patent Application Publication No. 2007-225264 (Abstract)

SUMMARY OF INVENTION

Technical Problem

However, although Patent Literature 1 refers to the uneven distribution correction control in a heating operation, no reference is made to the uneven distribution correction control in a cooling operation.

When an outdoor fan air volume or an outdoor heat exchange volume (flow path area) is different among the outdoor units in the air-conditioning apparatus including a plurality of outdoor units, the refrigerant distribution to each of the outdoor units may become uneven.

Normally, surplus refrigerant produced in the outdoor unit during the cooling operation is returned to an accumulator provided in the outdoor unit through a bypass pipe branched from a high-pressure liquid pipe connecting between a condenser and an expansion valve, and stored in the accumulator to control the flow rate of refrigerant required for the operation. However, when the amount of the surplus refrigerant exceeds the effective capacity of the accumulator, the refrigerant overflows, and thus the reliability of the compressor (outdoor unit) may be decreased. Thus, it is a common practice to detect the possibility of overflow in advance, and turn off the outdoor unit to thereby protect the compressor.

Further, in the case where the accumulator of each outdoor unit is configured to meet demands for reduction in size and cost, the refrigerant is more likely to overflow, and also the trouble involved with the resumption of the operation after the overflow has to be addressed.

The present invention has been accomplished in view of the foregoing problem, and provides an air-conditioning apparatus capable of correcting uneven refrigerant distribution to the outdoor units, thereby securing the reliability of the compressor.

Solution to Problem

The present invention provides an air-conditioning apparatus including a plurality of heat source units each including a compressor, a heat source-side heat exchanger, and an accumulator, a use-side unit including a use-side heat exchanger and a pressure reducing device, a bypass pipe provided in each of the plurality of heat source units and branched from a pipe between the heat source-side heat exchanger and the pressure reducing device to form a bypass to a suction side of the compressor, a flow control valve provided in the bypass pipe, a high-low pressure heat exchanger exchanging heat between low-pressure refrigerant and high-pressure refrigerant, the low-pressure refrigerant flowing through the bypass pipe between the flow control valve and the suction side of the compressor, the high-pressure refrigerant flowing between the heat source-side heat exchanger and the pressure reducing device, and a controller configured to decide whether liquid refrigerant is unevenly distributed among the plurality of heat source units, when the controller decides that the liquid refrigerant is unevenly distributed among the plurality of heat source units, the controller being configured to adjust an outlet subcooling degree of the heat source-side heat exchanger or an outlet subcooling degree at a high-pressure outlet of the high-low pressure heat exchanger, and a discharge superheating degree of the compressor in a low capacity-side heat source unit to match lower heat exchange capacity of the heat source-side heat exchanger in the low capacity-side heat source unit with higher heat exchange capacity of the heat source-side heat exchanger in a high capacity-side heat source unit, the low capacity-side heat source unit being one of the plurality of heat source units in which the heat source-side heat exchanger has the lower heat exchange capacity, the high capacity-side heat source unit being an other of the plurality of heat source units in which the heat source-side heat exchanger has the higher heat exchange capacity.

Advantageous Effects of Invention

With the air-conditioning apparatus according to the present invention, uneven refrigerant distribution to the outdoor units can be corrected, and the reliability of the compressor can be secured.

DESCRIPTION OF EMBODIMENTS

Embodiments of the present invention will be described below with reference to the drawings.

Embodiment 1

Figure 1:
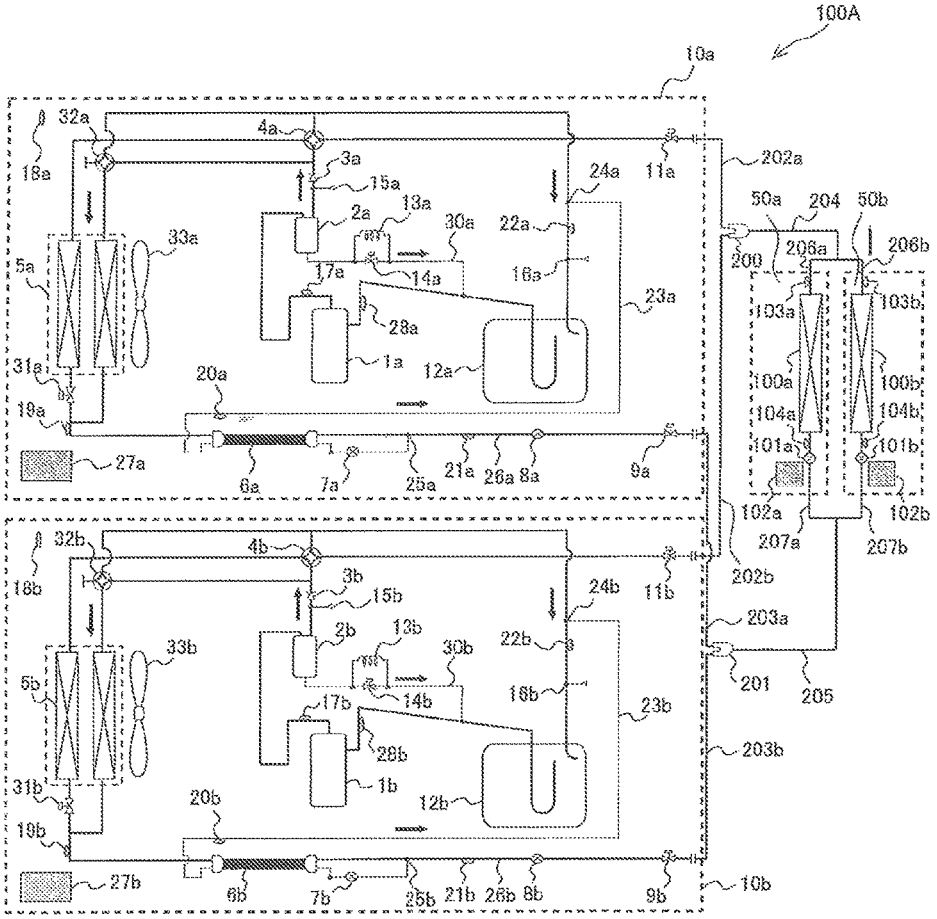
FIG. 1 is a circuit diagram showing a configuration of a refrigerant circuit of an air-conditioning apparatus 100A according to Embodiment 1 of the present invention.

FIG. 1 is a circuit diagram showing a configuration of a refrigerant circuit of an air-conditioning apparatus 100A according to Embodiment 1 of the present invention. With reference to FIG. 1, the circuit configuration and operation of the air-conditioning apparatus 100A will be described. The air-conditioning apparatus 100A is configured to perform a cooling operation and a heating operation utilizing a refrigeration cycle (heat pump cycle) in which refrigerant is made to circulate. The cooling operation will be described in accordance with the subject of the present invention.

As shown in FIG. 1, the air-conditioning apparatus 100A includes two heat source units (outdoor unit 10*a* and outdoor unit 10*b*) and two use-side units (indoor unit 50*a* and indoor unit 50*b*) connected via a refrigerant pipe. The two indoor units 50*a* and 50*b* are connected in parallel to the two outdoor units 10*a* and 10*b*. In other words, in the air-conditioning apparatus 100A, components provided in the two outdoor units 10*a* and 10*b* and components provided in the two indoor units 50*a* and 50*b* are connected via the refrigerant pipe to constitute a refrigerant circuit. The cooling operation or heating operation can be performed by causing the refrigerant to circulate through the refrigerant circuit.

The refrigerant pipe of the air-conditioning apparatus 100A includes gas diverging pipes 202*a* and 202*b*, gas branch pipes 206*a* and 206*b*, a gas pipe 204, liquid diverging pipes 203*a* and 203*b*, liquid branch pipes 207*a* and 207*b*, and a liquid pipe 205.

The gas diverging pipe 202*a* is connected to the outdoor unit 10*a*, and the gas diverging pipe 202*b* is connected to the outdoor unit 10*b*. The gas branch pipe 206*a* is connected to the indoor unit 50*a*, and the gas branch pipe 206*a* is connected to the indoor unit 50*a*. The gas pipe 204 is a common gas pipe connecting between the gas diverging pipes 202*a* and 202*b* and the gas branch pipes 206*a* and 206*b*.

The liquid diverging pipe 203*a* is connected to the outdoor unit 10*a*, and the liquid diverging pipe 203*b* is connected to the outdoor unit 10*a*. The liquid branch pipe 207*a* is connected to the indoor unit 50*a*, and the liquid branch pipe 207*b* is connected to the indoor unit 50*b*. The liquid pipe 205 is a common liquid pipe connecting between the liquid diverging pipes 203*a* and 203*b* and the liquid branch pipes 207*a* and 207*b*.

A gas distributor 200 is provided between the gas diverging pipes 202*a*, 202*b*, and the gas pipe 204, to connect these sections of the refrigerant pipe. Likewise, a liquid distributor 201 is provided between the liquid diverging pipes 203*a*, 203*b*, and the liquid pipe 205, to connect these sections of the refrigerant pipe. Although FIG. 1 illustrates the gas distributor 200 and the liquid distributor 201 provided in the air-conditioning apparatus 100A, it is not mandatory to employ the gas distributor 200 and the liquid distributor 201. The gas diverging pipe 202*a*, the gas diverging pipe 202*b*, and the gas pipe 204 constitute a gas pipe system, and the liquid diverging pipe 203*a*, the liquid diverging pipe 203*b*, and the liquid pipe 205 constitute a liquid pipe system.

The outdoor unit 10*a* and the indoor unit 50*a* are connected to each other via the gas diverging pipe 202*a*, the gas pipe 204, the gas branch pipe 206*a*, the liquid branch pipe 207*a*, the liquid pipe 205, and the liquid diverging pipe 203*a*. The outdoor unit 10*a* and the indoor unit 50*b* are connected to each other via the gas diverging pipe 202*a*, the gas pipe 204, the gas branch pipe 206*b*, the liquid branch pipe 207*b*, the liquid pipe 205, and the liquid diverging pipe 203*a*. Likewise, the outdoor unit 10*b* and the indoor unit 50*a* are connected to each other via the gas diverging pipe 202*b*, the gas pipe 204, the gas branch pipe 206*a*, the liquid branch pipe 207*a*, the liquid pipe 205, and the liquid diverging pipe 203*b*. The outdoor unit 10*b* and the indoor unit 50*b* are connected to each other via the gas diverging pipe 202*b*, the gas pipe 204, the gas branch pipe 206*b*, the liquid branch pipe 207*b*, the liquid pipe 205, and the liquid diverging pipe 203*b*.

The outdoor unit 10*a* includes a compressor 1*a*, an oil separator 2*a*, a check valve 3*a*, a four-way valve 4*a*, an outdoor heat exchanger 5*a*, a high-low pressure heat exchanger 6*a*, an outdoor unit incoming flow control valve (hereinafter, simply "flow control valve") 8*a*, a liquid-side on-off valve 9*a*, and a gas-side on-off valve 11*a*. The outdoor unit 10*a* also includes an accumulator 12*a*, an oil return bypass capillary 13*a*, an oil return bypass solenoid valve 14*a*, a high-low pressure heat exchanger bypass flow control valve (hereinafter, simply "bypass flow control valve") 7*a*, a heat exchange volume switching valve 31*a*, a heat exchange volume switching valve 32*a*, and an outdoor fan 33*a*. The compressor 1*a*, the oil separator 2*a*, the check valve 3*a*, the four-way valve 4*a*, the outdoor heat exchanger 5*a*, the high-low pressure heat exchanger 6*a*, the flow control valve 8*a*, the liquid-side on-off valve 9*a*, the gas-side on-off valve 11*a*, and the accumulator 12*a* are connected in series via the refrigerant pipe.

The high-low pressure heat exchanger 6*a* is provided in a liquid pipe 26*a* located between the outdoor heat exchanger 5*a* and the flow control valve 8*a*. The liquid pipe 26*a*, and a bypass pipe 23*a* branched from the liquid pipe 26*a* and connected to an upstream position of the accumulator 12*a*, are connected to the high-low pressure heat exchanger 6*a*. The bypass flow control valve 7*a* is provided in the bypass pipe 23*a* at a position upstream of the high-low pressure heat exchanger 6*a*.

The oil return bypass solenoid valve 14*a* is provided in an oil return bypass circuit 30*a* through which refrigerating machine oil separated by the oil separator 2*a* is returned to the suction side of the compressor 1*a*. In addition, an oil return bypass capillary 13*a* disposed to circumvent the oil return bypass solenoid valve 14*a* is provided for the oil return bypass circuit 30*a*.

Hereinafter, the point at which the liquid pipe 26*a* and the bypass pipe 23*a* are connected to each other will be referred to as a junction 25*a*, and the point at which the bypass pipe 23*a* and the pipe located upstream of the accumulator 12*a* (a section of refrigerant pipe disposed between the four-way valve 4*a* and the accumulator 12*a*) will be referred to as a junction 24*a*.

The outdoor unit 10*a* includes a controller 27*a* that controls the operation of the actuators provided in the outdoor unit 10*a*, namely, for example, the compressor 1*a*, the four-way valve 4*a*, and the outdoor fan 33*a*. Further, the outdoor unit 10*a* includes a first pressure sensor 15*a* a second pressure sensor 16*a*, a first temperature sensor 17*a*, a second temperature sensor 18*a*, a third temperature sensor 19*a*, a fourth temperature sensor 20*a*, a fifth temperature sensor 21*a*, a sixth temperature sensor 22*a*, and a seventh temperature sensor 28*a*. The temperature to be detected by these temperature sensors will be subsequently described.

The compressor 1*a* includes an inverter circuit, so that the rotation speed of the compressor is controlled through power supply frequency conversion performed by the inverter circuit, to thereby control the capacity, and serves to compress the sucked refrigerant to a high-temperature and high-pressure state. The oil separator 2*a* is provided on the discharge side of the compressor 1*a*, and serves to separate a refrigerating machine oil component from the refrigerant gas discharged from the compressor 1*a* and mixed with the refrigerating machine oil. The check valve 3*a* is provided in the refrigerant pipe between the oil separator 2*a* and the four-way valve 4*a*, and serves to prevent the refrigerant from flowing reversely to the discharge side of the compressor 1*a*, when the compressor 1*a* is turned off.

The four-way valve 4*a* serves as a flow switching device, to switch the flow of the refrigerant between the cooling operation and the heating operation. The outdoor heat exchanger 5*a* serves as a condenser (or a radiator) in the cooling operation and as an evaporator in the heating operation, and exchanges heat between air supplied from a non-illustrated outdoor fan and the refrigerant. The high-low pressure heat exchanger 6*a* exchanges heat between the refrigerant flowing in the liquid pipe 26*a* and the refrigerant flowing in the bypass pipe 23*a*. The flow control valve 8*a* is located downstream of the junction 25*a* in the cooling circuit, and serves as a pressure reducing valve, or an expansion valve, to reduce the pressure of the refrigerant to expand. It is preferable to employ a valve with variably controllable opening degree, such as an electronic expansion valve, as the flow control valve 8*a*.

The liquid-side on-off valve 9*a* is opened and closed by the controller 27*a* or manually, to allow or stop the flow of the refrigerant. The gas-side on-off valve 11*a* is also opened and closed by the controller 27*a* or manually, to allow or stop the flow of the refrigerant. The liquid-side on-off valve 9*a* and the gas-side on-off valve 11*b* are provided for adjusting pressure fluctuation in the refrigeration cycle, by the opening and closing actions. The accumulator 12*a* is provided on the suction side of the compressor 1*a*, and serves to store surplus refrigerant circulating in the refrigerant circuit.

The bypass flow control valve 7*a* is provided in the bypass pipe 23*a* at a position between the junction 25*a* and the high-low pressure heat exchanger 6*a*, and serves as a pressure reducing valve, or an expansion valve, to reduce the pressure of the refrigerant to expand. It is preferable to employ a valve with variably controllable opening degree, such as an electronic expansion valve, as the bypass flow control valve 7*a*. The oil return bypass circuit 30*a* serves to return the refrigerating machine oil separated by the oil separator 2*a* to the suction side of the compressor 1*a*. The oil return bypass capillary 13*a* serves to adjust the flow rate of the refrigerating machine oil passing through the oil return bypass circuit 30*a*. The oil return bypass solenoid valve 14*a* is controlled to be opened or closed, to thereby adjust the flow rate of the refrigerating machine oil, in cooperation with the oil return bypass capillary 13*a*.

The heat exchange volume switching valve 32*a* may be a four-way valve, for example, and serves to open and close the flow path directed to one of the two heat exchangers constituting the outdoor heat exchanger 5*a*, to change the heat exchange volume (heat transfer area) of the outdoor heat exchanger 5*a*.

The first pressure sensor 15*a* is provided between the oil separator 2*a* and the four-way valve 4*a*, and detects the pressure (high pressure) of the refrigerant discharged from the compressor 1*a*. The second pressure sensor 16*a* is provided upstream of the accumulator 12*a*, and detects the pressure (low pressure) of the refrigerant sucked into the compressor 1*a*. The first temperature sensor 17*a* is provided between the compressor 1*a* and the oil separator 2*a*, and detects the temperature of the refrigerant discharged from the compressor 1*a*. The second temperature sensor 18*a* detects the temperature around the outdoor unit 10*a*. The third temperature sensor 19*a* is provided between the outdoor heat exchanger 5*a* and the high-low pressure heat exchanger 6*a*, and detects the temperature of the refrigerant flowing between the outdoor heat exchanger 5*a* and the high-low pressure heat exchanger 6*a*.

The fourth temperature sensor 20*a* is provided in the bypass pipe 23*a* at a position downstream of the high-low pressure heat exchanger 6*a*, and detects the temperature of the refrigerant flowing through the bypass pipe 23*a* after passing through the high-low pressure heat exchanger 6*a*. The fifth temperature sensor 21*a* is provided between the junction 25*a* and the flow control valve 8*a*, and detects the temperature of the refrigerant flowing through the section between the junction 25*a* and the flow control valve 8*a* in the liquid pipe 26*a*. The sixth temperature sensor 22*a* is provided between the junction 24*a* and the accumulator 12*a*, and detects the temperature of the refrigerant flowing between the junction 24*a* and the accumulator 12*a*. The seventh temperature sensor 28*a* is provided between the accumulator 12*a* and the compressor 1*a*, and detects the temperature of the refrigerant sucked into the compressor 1*a*.

The pressure information detected by each of the pressure sensors and the temperature information detected by each of the temperature sensors are transmitted as signals to the controller 27*a*. The controller 27*a* is configured to control the actuators on the basis of the signals transmitted from the pressure sensors and the temperature sensors, as will be subsequently described in details. The type of the controller 27*a* is not specifically limited; however, for example, a microcomputer capable of controlling the actuators provided in the outdoor unit 10*a* is preferred to be employed.

Here, the outdoor unit 10*b* is configured the same as the outdoor unit 10*a*. In other words, the components of the outdoor unit 10*a* can be converted to those of the outdoor unit 10*b* by substituting the reference signs "a" with "b". Although the controller is provided in each of the outdoor unit 10*a* and the outdoor unit 10*b* in FIG. 1, a single controller may be employed to control both the outdoor unit 10*a* and the outdoor unit 10*b*. In the case where the outdoor unit 10*a* and the outdoor unit 10*b* each include the controller, the controllers in the respective outdoor units are configured to make wired or wireless communication with each other.

The indoor unit 50*a* includes an indoor heat exchanger 100*a* and an expansion valve 101*a* serially connected to each other via the gas branch pipe 206*a* and the liquid branch pipe 207*a*. The indoor unit 50 also includes a controller 102*a* that controls the operation of the actuators, such as the expansion valve 101*a* and a non-illustrated indoor fan, provided in the indoor unit 50*a*. Further, the indoor unit 50*a* includes an eighth temperature sensor 103*a* and a ninth temperature sensor 104*a*.

The indoor heat exchanger 100*a* serves as an evaporator in the cooling operation and as a condenser (or a radiator) in the heating operation, and exchanges heat between the refrigerant and air. The expansion valve 101*a* serves as a pressure reducing valve, or an expansion valve, to reduce the pressure of the refrigerant to expand. It is preferable to employ a valve with variably controllable opening degree, such as an electronic expansion valve, as the expansion valve 101*a*. The eighth temperature sensor 103*a* is provided in the gas branch pipe 206*a* connected to the indoor heat exchanger 100*a*, and detects the temperature of the refrigerant at the gas outlet of the indoor heat exchanger 100*a*. The ninth temperature sensor 104*a* is provided in the liquid branch pipe 207*a* connected to the indoor heat exchanger 100*a*, and detects the temperature of the refrigerant at the liquid outlet of the indoor heat exchanger 100*a*.

The temperature information detected by each of the temperature sensors is transmitted as signals to the controller 102*a*. The controller 102*a* is configured to control the actuators on the basis of the signals transmitted from the temperature sensors, as will be subsequently described in details. The type of the controller 102*a* is not specifically limited; however, for example, a microcomputer capable of controlling the actuators provided in the indoor unit 50*a* is preferred to be employed.

Here, the indoor unit 50*b* is configured the same as the indoor unit 50*a*. In other words, the components of the indoor unit 50*a* can be converted to those of the indoor unit 50*b* by substituting the reference signs "a" with "b". Although the controller is provided in each of the indoor unit 50*a* and the indoor unit 50*b* in FIG. 1, a single controller may be employed to control both the indoor unit 50*a* and the indoor unit 50*b*. In the case where the indoor unit 50*a* and the indoor unit 50*b* each include the controller, the controllers in the respective outdoor units are configured to make wired or wireless communication with each other. In addition, the controller provided in the indoor unit is capable of making wired or wireless communication with the controller provided in the outdoor unit. Hereinafter, when the overall operation of the controllers 27*a* and 27*b* is described, the controllers 27*a* and 27*b* may be collectively referred to as a controller 27.

Hereinafter, further, when it is not necessary to distinguish between the outdoor unit 10*a* and the outdoor unit 10*b*, the outdoor units may be collectively referred to as an outdoor unit 10. Likewise, the components in the outdoor unit 10 may also be expressed without the reference signs "a" and "b".

In the cooling circuit of the air-conditioning apparatus 100A, the components are connected so that the refrigerant flows in a direction indicated by solid arrows. More specifically, the components are connected so that the refrigerant sequentially flows through the compressor 1, the oil separator 2, the check valve 3, the four-way valve 4, the outdoor heat exchanger 5, the high-low pressure heat exchanger 6*a*, the flow control valve 8, the liquid-side on-off valve 9, the expansion valve 101, indoor heat exchanger 100, the gas-side on-off valve 11, the four-way valve 4, and the accumulator 12.

The operation of the air-conditioning apparatus 100A will be described below.

First, the operation performed by the air-conditioning apparatus 100A in the cooling operation will be described. In this case, the four-way valve 4 is switched to cause the refrigerant discharged from the compressor 1 to flow into the outdoor heat exchanger 5. In other words, in the four-way valve 4*a* and the four-way valve 4*b*, the pipes are connected in the direction indicated by solid lines in FIG. 1. In addition, the flow control valve 8 is fully closed or nearly fully open, the bypass flow control valve 7 and the expansion valve 101 are each set to an appropriate opening degree, when the operation is started. Under the mentioned setting, the refrigerant flows as follows.

The high-temperature and high-pressure gas refrigerant discharged from the compressor 1 passes through the oil separator 2 first. A substantially large portion of the refrigerating machine oil mixed in the refrigerant is separated from the refrigerant and stored in an inner bottom portion of the oil separator 2, and returned to the suction pipe of the compressor 1 through the oil return bypass circuit 30. (When the oil return bypass solenoid valve 14 is opened, the portion also passes through the oil return bypass solenoid valve 14.) Such an arrangement reduces the flow rate of the refrigerating machine oil flowing out of the outdoor unit 10, thereby improving the reliability of the compressor 1.

The high-temperature and high-pressure refrigerant with reduced content of the refrigerating machine oil passes through the four-way valve 4, is condensed and liquefied in the outdoor heat exchanger 5, and passes through the high-low pressure heat exchanger 6. A part of the refrigerant flowing out of the high-low pressure heat exchanger 6 flows into the bypass pipe 23, turns into low-temperature and low-pressure refrigerant through an appropriate flow control by the bypass flow control valve 7, and exchanges heat with the high-pressure refrigerant flowing out of the outdoor heat exchanger 5, in the high-low pressure heat exchanger 6. Thus, the refrigerant at the outlet of the high-low pressure heat exchanger 6 has lower enthalpy than that of the refrigerant at the outlet of the outdoor heat exchanger 5.

The low-pressure refrigerant passing through the bypass flow control valve 7 and flowing out of the high-low pressure heat exchanger 6 flows through the bypass pipe 23 to reach the junction 24 where the bypass pipe 23 is connected to the upstream pipe of the accumulator 12. The difference in enthalpy is increased accordingly, and thus the refrigerant flow rate required to attain the same capacity can be reduced, contributing to improving the performance by minimizing pressure loss. The terms high-pressure and low-pressure herein referred to represent the relative state of the pressure in the refrigerant circuit. The same also applies to the temperature.

Meanwhile, the refrigerant on the high pressure side flowing out of the high-low pressure heat exchanger 6 passes through the flow control valve 8, and is supplied to the liquid pipe 205 maintaining the state of the high-pressure liquid refrigerant, because the flow control valve 8 is fully open and hence the pressure is not remarkably reduced. The refrigerant then flows into the indoor unit 50, is depressurized in the expansion valve 101 to turn into low-pressure two-phase refrigerant, and is evaporated and gasified in the indoor heat exchanger 100. In this process, cooled air is supplied to a space to be air-conditioned, such as a room, so that the cooling operation for the space to be air-conditioned is realized. The refrigerant flowing out of the indoor heat exchanger 100 passes through the gas branch pipes 206*a* and 206*b*, the gas pipe 204, the four-way valve 4, and the accumulator 12, and is again sucked into the compressor 1.

Here, when the refrigerant in the gas-liquid two-phase state flows into the accumulator 12, the liquid refrigerant deposits in the lower portion of the container. A U-shaped pipe is provided in the accumulator 12 as shown in FIG. 1, so that the gas-rich refrigerant flowing into the U-shaped pipe from the upper opening thereof flows out of the accumulator 12. Such a configuration of the accumulator 12 allows the gas-rich refrigerant to be sucked into the compressor 1. Thus, the transitional refrigerant in the liquid phase or gas-liquid two-phase state can be retained in the accumulator 12 to temporarily prevent reverse flow of the liquid refrigerant to the compressor 1, until the refrigerant overflows. Thus, the reliability of the compressor 1 can be maintained.

The controlling operation of the controller 27 in the air-conditioning apparatus 100A will be described below. The indoor heat exchangers 100*a* and 100*b* act as evaporators in the cooling operation, and thus the evaporation temperature (two-phase refrigerant temperature in the evaporator) is determined to attain a predetermined heat exchange capacity, and the value of the pressure that realizes such evaporation temperature is determined as a low pressure target value. Then the controller 27 controls the rotation speed of each of the compressors 1*a* and 1 *b* through the inverter circuit. The operation capacity of each of the compressors 1*a* and 1*b* is determined so that the pressure measured by each of the second pressure sensors 16*a* and 16*b* matches a predetermined target value, for example, a pressure corresponding to a saturation temperature of 10 degrees Celsius. Although the condensation temperature (two-phase refrigerant temperature in the condenser) also varies owing to the rotation speed control, a certain range of temperature is set as condensation temperature and the value of a pressure that realizes the condensation temperature is determined as a high pressure target Pd, to secure the desired level of performance and reliability.

In addition, the opening degree of each of the expansion valves 101*a* and 101*b* is adjusted so that the outlet superheating degree of a corresponding one of the indoor heat exchangers 100*a* and 100*b* matches a target (temperature) value. A predetermined target value, for example, 5 degrees Celsius, is employed as a target value. Controlling to attain the target outlet superheating degree enables the ratio of the two-phase refrigerant in each of the indoor heat exchangers 100*a* and 100*b* to be maintained at a desirable level.

Each of the flow control valves 8*a* and 8*b* is set to a predetermined initial opening degree, for example, fully open, or nearly fully open. The opening degree of each of the bypass flow control valves 7*a* and 7*b* is controlled so that the degree of superheating SHB at the outlet of the bypass pipe 23*b* matches a target value SHB_0 for the normal operation.

Figure 2:
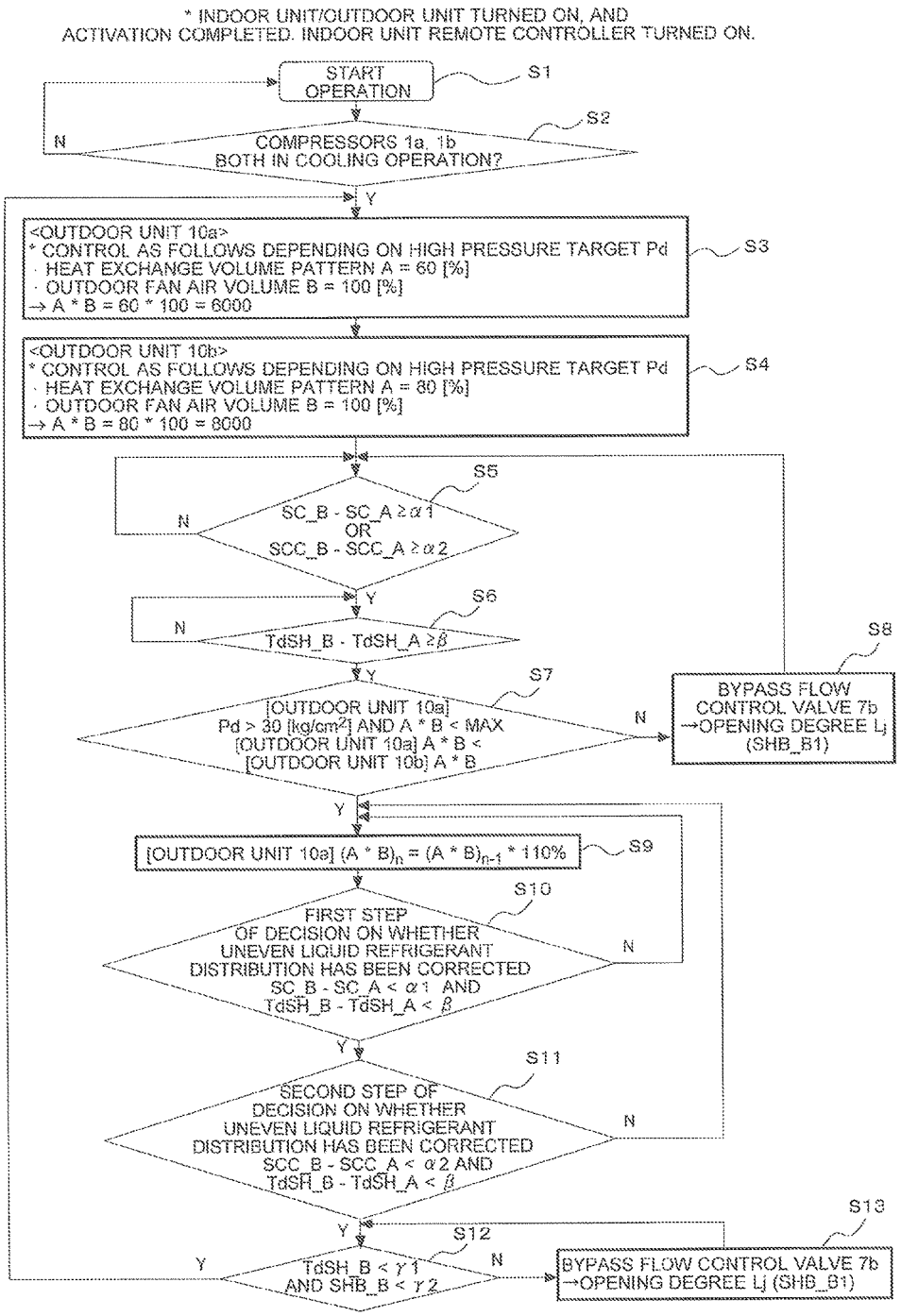
FIG. 2 is a flowchart showing a control process according to Embodiment 1 of the present invention.

The controller 27 further performs the control as described in a flowchart shown in FIG. 2, to correct uneven distribution of the liquid refrigerant to each outdoor unit 10.

FIG. 2 is the flowchart showing the control process according to Embodiment 1 of the present invention. With reference to FIG. 2, the control process according to Embodiment 1 will be described in details. First, when the user turns on a non-illustrated indoor unit remote controller, the compressor 1 is activated. The operation of the air-conditioning apparatus 100A is started when the compressor 1 is activated (step S1).

The controller 27 decides whether the compressor 1*a* and the compressor 1*b* are both in the cooling operation, when a predetermined time elapses after the operation is started at step S1 (step S2). When the controller 27 decides that the compressor 1*a* and the compressor 1*b* are both in the cooling operation, the controller 27 performs the following control. The controller 27 switches a heat exchange volume pattern A of the outdoor heat exchanger 5 of each of the outdoor units 10 to match the high pressure with the high pressure target Pd as described above, and determines a volume of air passing through each of the outdoor heat exchangers 5 driven by the outdoor fan 33 (hereinafter, outdoor fan air volume B) (step S3, step S4). Here, the switching of the heat exchange volume pattern A is performed using the heat exchange volume switching valves 31 and 32.

In the example shown in FIG. 2, the heat exchange volume pattern A of the outdoor unit 10*a* is set to 60% and the outdoor fan air volume B is set to 100%, while the heat exchange volume pattern A of the outdoor unit 10*b* is set to 80% and the outdoor fan air volume B is set to 100%. These numerical values are merely exemplary, and naturally vary depending on the use condition (load) of the indoor unit 50.

At steps S3 and S4, the controller 27 calculates a value obtained by multiplying the heat exchange volume pattern A by the outdoor fan air volume B. The value obtained through such calculation serves as an index indicating the heat exchange capacity (heat exchange volume) of the outdoor heat exchanger 5.

The controller 27 then decides whether the liquid refrigerant is unevenly distributed, on the basis of the operation state quantity of each of the outdoor units 10 (step S5). More specifically, the controller 27 decides that the distribution of the liquid refrigerant is biased to the outdoor unit 10*b*, when either of the following conditions (1) and (2) is satisfied.

(1) A temperature difference between the outlet subcooling degrees SC_A and SC_B (SC_B-SC_A) of the respective outdoor heat exchangers 5*a* and 5*b* of the outdoor units 10*a* and 10*b* is equal to or larger than a predetermined threshold $\alpha$1.

(2) A temperature difference between the outlet subcooling degrees SCC_A and SCC_B (SCC_B-SCC_A) at the high-pressure outlets of the respective high-low pressure heat exchangers 6*a* and 6*b* of the outdoor units 10*a* and 10*b* is equal to or larger than a predetermined threshold $\alpha$2.

Here, the outlet subcooling degree SC_A of the outdoor heat exchanger 5*a* can be obtained by subtracting a temperature TH3A detected by the third temperature sensor 19*a* from a saturation temperature TcA corresponding to a high pressure PdA detected by the first pressure sensor 15*a*. The outlet subcooling degree SC_B of the outdoor heat exchanger 5*b* can be obtained by subtracting a temperature TH3B detected by the third temperature sensor 19*b* from a saturation temperature TcB corresponding to a high pressure PdB detected by the first pressure sensor 15*b*.

The outlet subcooling degrees SCC_A at the high-pressure outlet of the high-low pressure heat exchanger 6*a* can be obtained by subtracting a temperature TH5A detected by the fifth temperature sensor 21*a* from the saturation temperature TcA corresponding to the high pressure PdA. The outlet subcooling degrees SCC_B at the high-pressure outlet of the high-low pressure heat exchanger 6*b* can be obtained by subtracting a temperature TH5B detected by the fifth temperature sensor 21*b* from the saturation temperature TcB corresponding to the high pressure PdB.

In the case where the controller 27 decides that the distribution of the liquid refrigerant is biased to the outdoor unit 10*b* at step S5, the controller 27 further decides whether it is necessary to correct the uneven distribution of the liquid refrigerant, at step S6. The controller 27 decides that it is necessary to correct the uneven liquid refrigerant distribution, when the following condition (3) is satisfied.

(3) A temperature difference between the discharge superheating degrees TdSH_A and TdSH_B of the respective compressors 1*a* and 1 *b* of the outdoor units 10*a* and 10*b* (TdSH_B-TdSH_A) is equal to or larger than a predetermined threshold $\beta$.

Here, the discharge superheating degree TdSH_A of the compressor 1*a* can be obtained by subtracting the temperature TcA from a temperature TH1A detected by the first temperature sensor 17*a*. The discharge superheating degree TdSH_B of the compressor 1*b* can be obtained by subtracting the temperature TcB from a temperature TH1B detected by the first temperature sensor 17*b*. At this point, a value obtained by subtracting each of saturation temperatures TeA and TeB corresponding to low pressures PsA and PsB detected by the second pressure sensors 16*a* and 16*b* from a corresponding one of the temperatures TH3A and TH3B detected by the third temperature sensors 19*a* and 19*b* may be adopted as discharge superheating degrees TdSH_A and TdSH_B, enabling to attain the same effect.

At step S5, when the controller 27 decides that the distribution of the liquid refrigerant biased to the outdoor unit 10*b* has to be corrected, the controller 27 performs the control for correcting the unevenness (steps S7 to S13). First, the outline of the control for correcting the unevenness will be described. The controller 27 performs the control as follows, to match the heat exchange capacities of the outdoor units 10*a* and 10*b*. The controller 27 adjusts the operation state quantity of the outdoor unit 10*a* on the low-capacity side, out of the outdoor units 10*a* and 10*b*, so that the heat exchange capacity of the outdoor unit 10*a* on the low-capacity side, in which the outdoor heat exchanger 5 has smaller heat exchange capacity (value of A*B is smaller) matches the heat exchange capacity of the outdoor unit 10*b* on the high-capacity side, in which the heat exchange capacity of the outdoor heat exchanger 5 is larger (value of A*B is larger). The operation state quantity adjusted at this point includes the outlet subcooling degree of the outdoor heat exchanger 5*a* or the outlet subcooling degree at the outlet of the high-low pressure heat exchanger 6*a*, and the discharge superheating degree of the compressor 1*a*.

To be more detailed, the controller 27 adjusts at least one of the heat exchange volume pattern A and the outdoor fan air volume B of the low capacity-side outdoor unit 10, to increase the heat exchange capacity (A*B) of the low capacity-side outdoor unit 10*a*, for example, in increments of 10%. The uneven liquid refrigerant distribution can be corrected through such control, which will be described in further details below.

At step S6, when the controller 27 decides that the uneven liquid refrigerant distribution has to be corrected, the controller 27 compares the A*B of the outdoor unit 10*a* and the A*B of the outdoor unit 10*b*, and decides which of the outdoor units 10*a* and 10*b* is the low capacity-side outdoor unit 10 (step S7). In this example, the A*B of the outdoor unit 10*a* is 6000 and the A*B of the outdoor unit 10*b* is 8000, and hence the outdoor unit 10*a* is decided to be the low capacity-side outdoor unit 10. Then the controller 27 decides whether the low capacity-side outdoor unit 10*a* satisfies the following conditions. Specifically, the controller 27 decides whether "the high pressure of the outdoor unit 10*a* exceeds 30 [kg/cm$^2$], for example, and the A*B of the outdoor unit 10*a* is below the upper limit of the capacity range (Max=10000)" (step S7), and in the case where the condition is satisfied, the controller 27 proceeds to step S9.

At step S9, the controller 27 adjusts at least one of the heat exchange volume pattern A and the outdoor fan air volume B of the outdoor unit 10*a*, to make the $(A*B)_n$ of the outdoor unit 10*a* set this time (n-th time) larger by 10% than the $(A*B)_{n-1}$ set the previous time (step S9).

Increasing thus the A*B of the outdoor unit 10*a*, in other words increasing the heat exchange capacity of the outdoor heat exchanger 5*a* causes the outlet subcooling degree SC_A of the outdoor heat exchanger 5*a* to increase, so that the refrigerant is transferred to the outdoor heat exchanger 5*a* from the outdoor heat exchanger 5*b*. Here, in the case where the A*B of the outdoor unit 10*a* has reached the maximum value when the A*B is to be adjusted at step S9, the A*B is unable to be increased any more. For this reason, it is decided at step S7 whether "the A*B of the outdoor unit 10*a* is below the upper limit of the capacity range (Max=10000)".

In contrast, in the case where the conditions that "the high pressure of the outdoor unit 10*a* exceeds 30 [kg/cm$^2$], for example, and the A*B of the outdoor unit 10*a* is below the upper limit of the capacity range (Max=10000)" are not satisfied, the following control is performed. The controller 27 adjusts the opening degree Lj of the bypass flow control valve 7*b*, to match the degree of superheating SHB_B at the outlet of the bypass pipe 23*b* of the outdoor unit 10*b* with a target value SHB_B1 (<SHB_0) predetermined for the case where the liquid refrigerant is unevenly distributed (step S8). Here, also in the case where the A*B of the outdoor unit 10*b* and the A*B of the outdoor unit 10*a* are both at the maximum, the process of step S8 is performed.

Through the mentioned control of the bypass flow control valve 7*b*, the flow rate of the refrigerant directed to the accumulator 12*b* through the bypass pipe 23*b* is increased, and thus surplus liquid refrigerant is temporarily stored in the accumulator 12*b*. Temporarily storing the surplus liquid refrigerant in the accumulator 12*b* reduces an excessive increase of the outlet subcooling degree SC_B of the outdoor heat exchanger 5*b* or the outlet subcooling degree SCC_B at the high-pressure outlet of the high-low pressure heat exchanger 6*b*.

When a predetermined period of time elapses after the controller 27 increases the A*B of the outdoor unit 10*a*, the controller 27 decides whether a [first step of decision on whether uneven liquid refrigerant distribution has been corrected] has been completed (step S10). Specifically, the controller 27 decides that the [first step of decision on whether uneven liquid refrigerant distribution has been corrected] has been completed, in the case where a "difference between SC_B and SC_A is below the threshold $\alpha$1 (SC_B-SC_A<$\alpha$1)" and a "difference between TdSH_B and TdSH_A is below the threshold $\beta$ (TdSH_B-TdSH_A<$\beta$)". When the controller 27 decides that the [first step of decision on whether uneven liquid refrigerant distribution has been corrected] has been completed, the controller 27 proceeds to step S11. However, in the case where the mentioned conditions of step S10 are not satisfied, the controller 27 repeats the process of step S9, until these conditions are satisfied.

When the conditions of step S10 are satisfied, the controller 27 decides that the [first step of decision on whether uneven liquid refrigerant distribution has been corrected] has been completed, and then decides whether a [second step of decision on whether uneven liquid refrigerant distribution has been corrected] has been completed (step S11). Specifically, the controller 27 decides that the uneven liquid refrigerant distribution between the outdoor units 10*a* and 10*b* has been corrected, in the case where a "difference between SCC_B and SCC_A is below the predetermined threshold $\alpha$2 (SCC_B-SCC_A<$\alpha$1)" and the "difference between TdSH_B and TdSH_A is below the predetermined threshold $\beta$ (TdSH_B-TdSH_A<$\beta$)". However, as in the process of step S10, in the case where the mentioned conditions of step S11 are not satisfied, the controller 27 repeats the process of step S9 to step S11, until the respective conditions of step S10 and step Share satisfied.

When the respective conditions of step S10 and step Share satisfied, the controller 27 decides that the [first and second steps of decision on whether uneven liquid refrigerant distribution has been corrected] have been completed. Finally, the controller 27 makes decision for confirming that the biased refrigerant distribution to the outdoor unit 10*b* has been corrected (step S12). Specifically, the controller 27 decides that the biased liquid refrigerant distribution to the outdoor unit 10*b* has been corrected, in the case where the "TdSH_B is below a predetermined threshold γ1" and the "SHB_B is below a predetermined threshold γ2".

In the case where the mentioned conditions of step S12 are not satisfied, the controller 27 repeatedly adjusts the opening degree Lj of the bypass flow control valve 7*b* (step S13) to match the degree of superheating SHB_B at the outlet of the bypass pipe 23*b* with the target value SHB_B1 (<SHB_0) predetermined for the case where the liquid refrigerant is unevenly distributed. When the controller 27 decides that the conditions of step S12 are satisfied, the controller 27 decides that the correction of the biased distribution of the liquid refrigerant to the outdoor unit 10*b* has been confirmed, and returns to step S3.

Through the foregoing control, the uneven distribution of the liquid refrigerant in the cooling operation can be corrected, and thus the reliability of the compressor can be secured.

As described thus far, in Embodiment 1, the outlet subcooling degree of the outdoor heat exchanger 5 or the outlet subcooling degree at the high-pressure outlet of the high-low pressure heat exchanger 6, and the discharge superheating degree of the compressor 1 are adjusted to match the heat exchange capacities of the outdoor heat exchangers 5 of the respective outdoor units 10. Thus, the refrigerant distribution status to the outdoor units 10*a* and 10*b* can be set generally the same (uniform), to distribute the refrigerant to the outdoor unit 10*a* and 10*b* without remarkable unevenness. In addition, the correction of the uneven refrigerant distribution prevents the liquid refrigerant from overflowing from the accumulator 12, to thereby secure the reliability of the outdoor unit (compressor).

To match the heat exchange capacities of the outdoor heat exchangers 5 of the respective outdoor units 10, the lower heat exchange capacity is matched with the higher heat exchange capacity. Such an arrangement prevents the comfortableness in the room from being decreased owing to insufficient cooling capacity, during the correction process of the uneven liquid refrigerant distribution.

Embodiment 2

Figure 3:
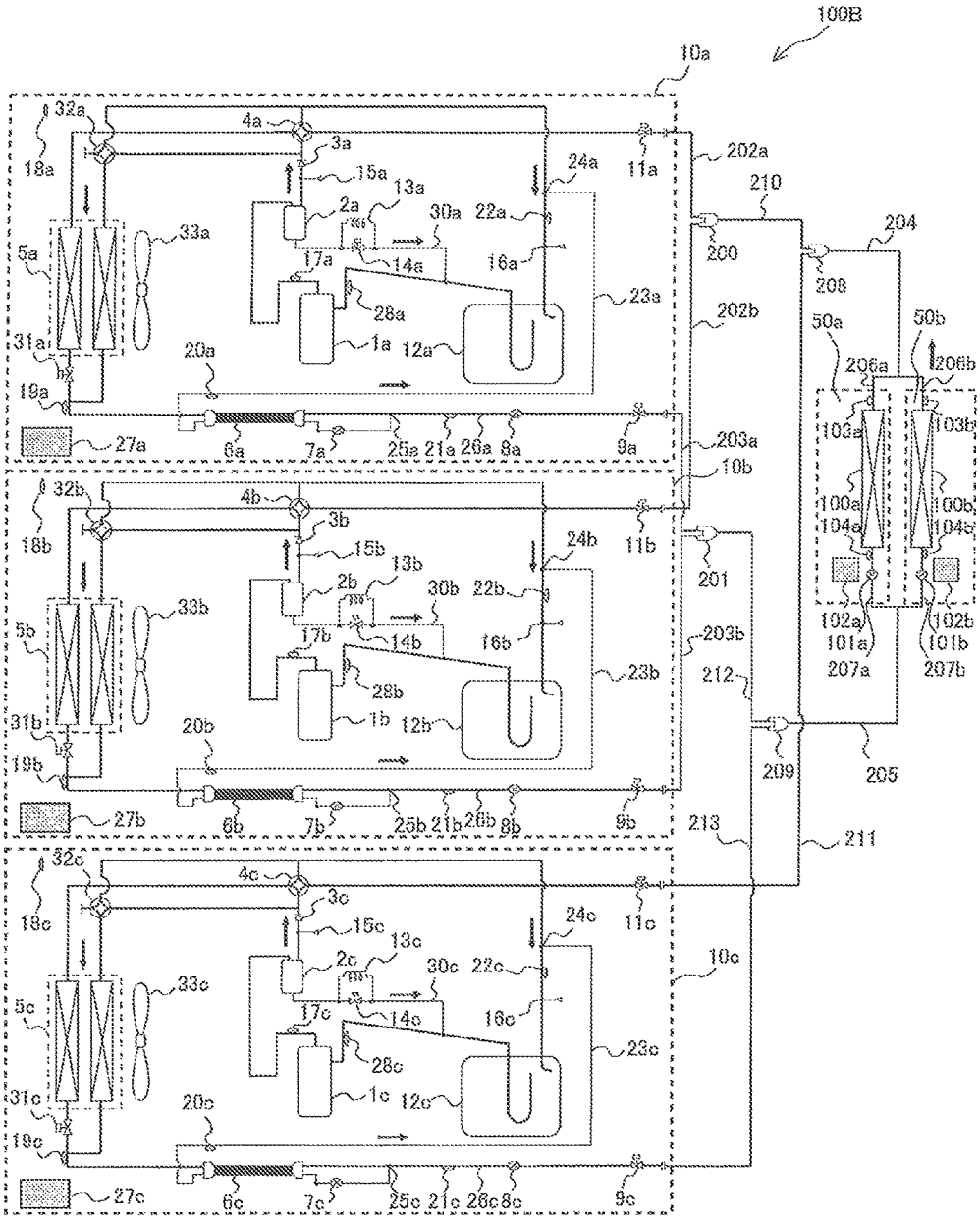
FIG. 3 is a circuit diagram showing a configuration of a refrigerant circuit of an air-conditioning apparatus 100B according to Embodiment 2 of the present invention.

FIG. 3 is a circuit diagram showing a configuration of a refrigerant circuit of an air-conditioning apparatus 100B according to Embodiment 2 of the present invention. In the air-conditioning apparatus 100B shown in FIG. 3, the same components as those of the air-conditioning apparatus 100A according to Embodiment 1 are given the same reference signs. Regarding Embodiment 2, differences from Embodiment 1 will be primarily focused on.

Embodiment 1 represents a system in which two outdoor units and two indoor units are connected to each other, while Embodiment 2 represents a system in which three outdoor units and two indoor units are connected to each other. In other words, the air-conditioning apparatus 100B includes three heat source units (outdoor unit 10*a*, outdoor unit 10*b*, and outdoor unit 10*c*) and two use-side units (indoor unit 50*a* and indoor unit 50*b*), connected to each other via the refrigerant pipe. The third outdoor unit 10*c* has the same configuration as that of the outdoor unit 10*a*. In other words, the components of the outdoor unit 10*a* can be converted to those of the outdoor unit 10*c* by substituting the reference signs "a" with "c". The basic operation of the air-conditioning apparatus 100B is also the same as that of the air-conditioning apparatus 100A. Here, the air-conditioning apparatus 100B additionally includes a gas distributor 208, a liquid distributor 209, gas diverging pipes 210 and 211, and liquid diverging pipes 212 and 213 compared with the air-conditioning apparatus 100A, because of the addition of the third outdoor unit 10*c*.

Figure 4:
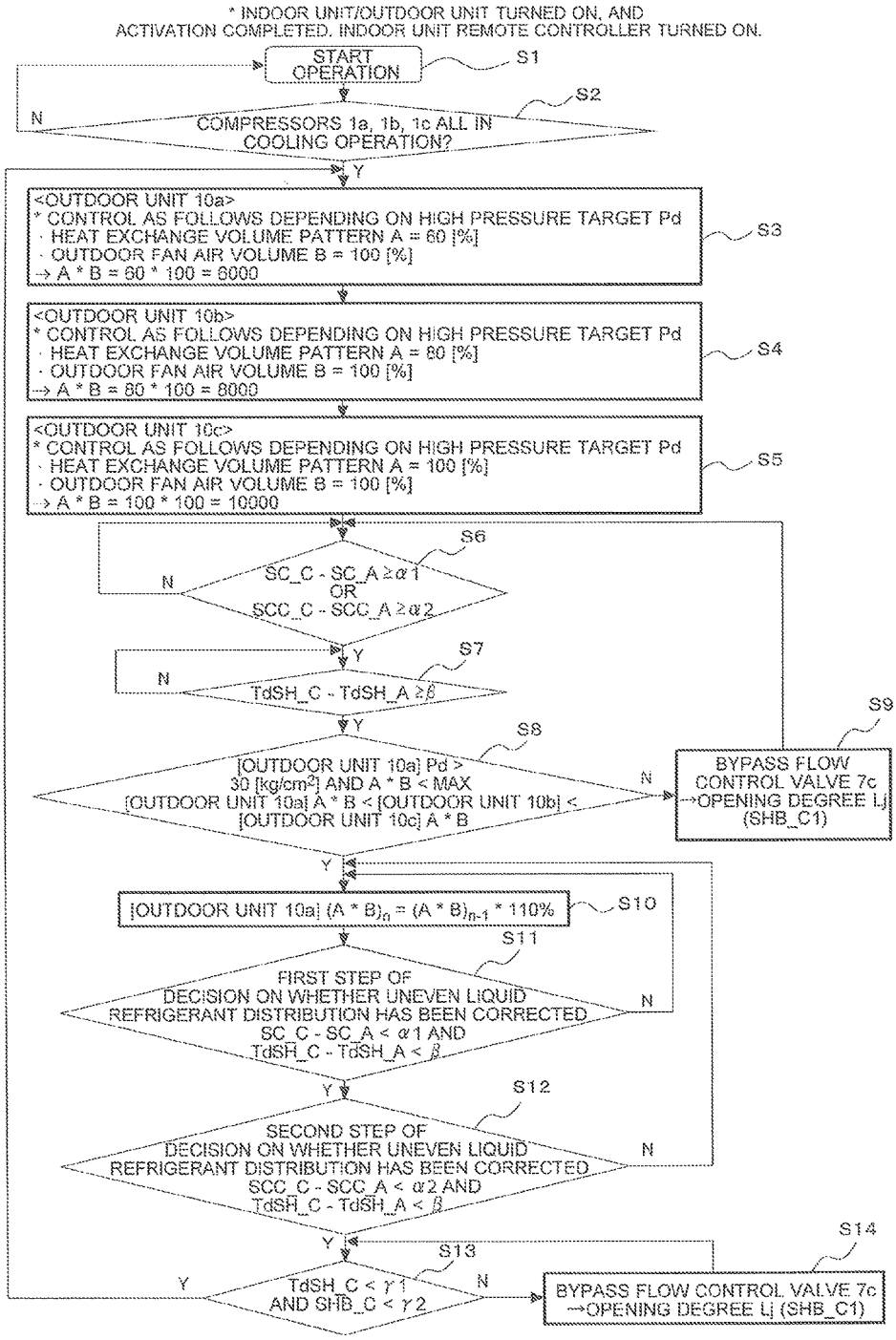
FIG. 4 is a flowchart showing a control process according to Embodiment 2 of the present invention.

FIG. 4 is a flowchart showing the control process according to Embodiment 2 of the present invention. With reference to FIG. 4, the control process performed by the controller 27 (uneven distribution correction control in the cooling operation), which is the distinctive feature of Embodiment 2, will be described in details.

The air-conditioning apparatus 100B includes three or more (in this case, three) outdoor units 10*a*, 10*b*, and 10*c* connected to each other. Thus, when the distribution of the liquid refrigerant is biased to one of the outdoor units (for instance, outdoor unit 10*c*) as in the air-conditioning apparatus 100A of Embodiment 1, naturally the transfer process of the liquid refrigerant to the remaining outdoor units 10*a* and 10*b* is more complicated. In the air-conditioning apparatus 100B, thus, the operation described below is performed, to correct the uneven distribution as in Embodiment 1 despite three or more outdoor units being involved, to thereby restore an optimum refrigerant distribution status.

When a predetermined time elapses after the operation is started at step S1, the controller 27 decides whether the compressor 1*a*, the compressor 1*b*, and the compressor 1*c* are all in the cooling operation (step S2). When the controller 27 decides that the compressor 1*a*, the compressor 1*b*, and the compressor 1*c* are all in the cooling operation, the controller 27 performs the following control. The controller 27 switches the heat exchange volume pattern A of the outdoor heat exchanger 5 of each of the respective outdoor units 10 to match the high pressure with the high pressure target Pd as described above, and determines the volume of air passing through each of the outdoor heat exchangers 5 driven by the outdoor fan 33 (hereinafter, outdoor fan air volume B). The controller 27 also calculates the A*B representing the heat exchange capacity of the outdoor heat exchanger 5, with respect to each of the outdoor units 10 (step S3 to step S5).

In the example shown in FIG. 4, the heat exchange volume pattern A and the outdoor fan air volume B of the outdoor units 10*a* and 10*b* are the same as those of Embodiment, and the heat exchange volume pattern A of the outdoor unit 10*b* is set to 100% and the outdoor fan air volume B is set to 100%, so that the A*B becomes 10000. These numerical values are merely exemplary, and naturally vary depending on the use condition (load) of the indoor unit 50.

The controller 27 then decides whether the liquid refrigerant is unevenly distributed, on the basis of the operation state quantity of each of the outdoor units 10 (step S6). More specifically, the controller 27 decides that the distribution of the liquid refrigerant is biased to the outdoor unit 10*c*, when either of the following conditions (1) and (2) is satisfied.

(1) Whether a temperature difference between a highest value and a lowest value, among the outlet subcooling degrees SC_A, SC_B, and SC_C of the outdoor heat exchangers 5*a*, 5*b*, and 5*c* each included in a corresponding one of the outdoor units 10*a*, 10*b*, and 10*c*, is equal to or larger than the predetermined threshold α1 is decided (step S6). In this example, it is assumed that the maximum value is SC_C and the minimum value is SC_A, and it is decided whether SC_C-SC_A is equal to or larger than the threshold α1.

(2) Whether a temperature difference between a maximum value and a minimum value, among the outlet subcooling degrees SCC_A, SCC_B, and SCC_C at the high-pressure outlets of the high-low pressure heat exchangers 6*a*, 6*b*, and 6*c* each included in a corresponding one of the outdoor units 10*a*, 10*b*, and 10*c*, is equal to or larger than the predetermined threshold α2 is decided (step S6). In this example, it is assumed that the maximum value is SCC_C and the minimum value is SCC_A, and it is decided whether SCC_C-SCC_A is equal to or larger than the threshold α2.

At step S6 described above, it is decided whether the distribution of the liquid refrigerant is biased to the outdoor unit 10*c*. When the controller 27 decides that the liquid refrigerant distribution is biased to the outdoor unit 10*c*, the controller 27 further decides whether it is necessary to correct the uneven distribution of the liquid refrigerant, at step S7. The controller 27 decides that it is necessary to correct the uneven liquid refrigerant distribution, when the following condition (3) is satisfied.

(3) Whether a temperature difference between a maximum value and a minimum value, among the discharge superheating degrees TdSH_A. TdSH_B, and TdSH_C of the compressors 1*a*, 1*b*, and 1*c* each included in a corresponding one of the outdoor units 10*a*, 10*b*, and 10*c*, is equal to or larger than the predetermined threshold β (step S7). In this example, it is assumed that the maximum value is TdSH_C and the minimum value is TdSH_A, and it is decided whether TdSH_C-TdSH_A is equal to or larger than the threshold β.

At step S7, when the controller 27 decides that the distribution of the liquid refrigerant biased to the outdoor unit 10*c* has to be corrected, the controller 27 performs the control for correcting the unevenness (steps S8 to S14). The principle of the control for correcting the unevenness is the same as that of Embodiment 1. Thus, the controller 27 adjusts the operation state quantity of the outdoor unit 10*a* on the low-capacity side, out of the outdoor units 10*a*, 10*b*, and 10*c*, so that the heat exchange capacity of the outdoor unit 10*a* on the low capacity-side, in which the outdoor heat exchanger 5 has the minimum heat exchange capacity, matches the heat exchange capacity of the outdoor unit 10*c* on the high-capacity side, in which the outdoor heat exchanger 5 has the maximum heat exchange capacity. The operation state quantity adjusted at this point includes, as in Embodiment 1, the outlet subcooling degree of the outdoor heat exchanger 5*a* or the outlet subcooling degree at the outlet of the high-low pressure heat exchanger 6*a*, and the discharge superheating degree of the compressor 1*a*. The process of each of steps S8 to S14 will be described below.

The controller 27 identifies, as stated above, the outdoor unit 10 on the low capacity-side, in which the outdoor heat exchanger 5 has the minimum heat exchange capacity, and the outdoor unit 10 on the high-capacity side, in which the outdoor heat exchanger 5 has the maximum heat exchange capacity (step S8), out of the outdoor units 10*a*, 10*b*, and 10*c*. In this example, the A*B of the outdoor unit 10*a* is 6000, the A*B of the outdoor unit 10*b* is 8000, and the A*B of the outdoor unit 10*c* is 10000, and hence the outdoor unit 10*a* is decided to be the low capacity-side outdoor unit 10, and the outdoor unit 10*c* is decided to be the high capacity-side outdoor unit 10.

Then the controller 27 decides whether the low capacity-side outdoor unit 10*a* satisfies the following conditions. Specifically, the controller 27 decides whether "the high pressure of the outdoor unit 10*a* exceeds 30 [kg/cm$^2$], for example, and the A*B of the outdoor unit 10*a* is below the upper limit of the capacity range (Max=10000)" (step S8), and in the case where the condition is satisfied, the controller 27 proceeds to step S10.

At step S10, the controller 27 adjusts at least one of the heat exchange volume pattern A and the outdoor fan air volume B of the outdoor unit 10*a*, to make the $(A*B)_n$ of the outdoor unit 10*a* set this time (n-th time) larger by 10% than the $(A*B)_{n-1}$ set the previous time (step S10).

Increasing thus the A*B of the outdoor unit 10*a* causes the outlet subcooling degree SC_A of the outdoor heat exchanger 5*a* to increase, so that the refrigerant is transferred to the outdoor heat exchanger 5*a* from the outdoor heat exchanger 5*c*. Here, in the case where the A*B of the outdoor unit 10*a* has reached the maximum value, the controller 27 adjusts the opening degree Lj of the bypass flow control valve 7*c*, to match the degree of superheating SHB_C at the outlet of the bypass pipe 23*c* with the predetermined target value SHB_C1 (<SHB_0) (step S9).

Through the mentioned control of the bypass flow control valve 7*c*, the flow rate of the refrigerant directed to the accumulator 12*c* through the bypass pipe 23*c* is increased, and thus surplus liquid refrigerant is temporarily stored in the accumulator 12*c*. Temporarily storing the surplus liquid refrigerant in the accumulator 12*c* reduces an excessive increase of the outlet subcooling degree SC_C of the outdoor heat exchanger 5*c* or the outlet subcooling degree SCC_C at the high-pressure outlet of the high-low pressure heat exchanger 6*c*.

When a predetermined period of time elapses after the controller 27 increases the A*B of the outdoor unit 10*a*, the controller 27 decides whether the [first step of decision on whether uneven liquid refrigerant distribution has been corrected] has been completed (step S11). This decision is made on the basis of the operation state quantity of each of the outdoor unit 10*c* on the high-capacity side and the outdoor unit 10*a* on the low-capacity side. Specifically, the controller 27 decides that the [first step of decision on whether uneven liquid refrigerant distribution has been corrected] has been completed, in the case where a "difference between SC_C and SC_A is below the threshold α1 (SC_B-SC_A<α1)" and a "difference between TdSH_C and TdSH_A is below the threshold β (TdSH_B-TdSH_A<β)". When the controller 27 decides that the [first step of decision on whether uneven liquid refrigerant distribution has been corrected] has been completed, the controller 27 proceeds to step S12. However, in the case where the mentioned conditions of step S11 are not satisfied, the controller 27 repeats the process of step S10, until the [first step of decision on whether uneven liquid refrigerant distribution has been corrected] of step S11 is completed.

The controller 27 then decides whether the [second step of decision on whether uneven liquid refrigerant distribution has been corrected] has been completed (step S12). This decision is made on the basis of the outlet subcooling degree SCC of each of the outdoor unit 10*c* in which the outlet subcooling degree SCC at the high-pressure outlet of the high-low pressure heat exchanger 6 is highest, and the outlet subcooling degree SCC of the outdoor unit 10*a* in which the outlet subcooling degree SCC at the high-pressure outlet of the high-low pressure heat exchanger 6 is lowest. Specifically, the controller 27 decides that the uneven liquid refrigerant distribution among the plurality of outdoor units 10*a* and 10*b* has been corrected, in the case where a "difference between SCC_B and SCC_A is below the predetermined threshold α2 (SCC_B-SCC_A<α1)" and the "difference between TdSH_B and TdSH_A is below the predetermined threshold β (TdSH_B-TdSH_A<β)". However, as in the process of step S11, in the case where the mentioned conditions are not satisfied, the controller 27 repeats the process of step S10, until the [first and second steps of decision on whether uneven liquid refrigerant distribution has been corrected] of steps S11 and S12 are completed.

When the controller 27 decides that the [first and second steps of decision on whether uneven liquid refrigerant distribution has been corrected] have been completed, the controller 27 finally makes decision for confirming that the biased refrigerant distribution to the outdoor unit 10*c* has been corrected (step S1). Specifically, the controller 27 decides that the biased liquid refrigerant distribution to the outdoor unit 10*c* has been corrected, in the case where the "TdSH_C is below the predetermined threshold γ1" and the "SHB_C is below the predetermined threshold γ2".

In the case where the mentioned conditions of step S13 are not satisfied, the controller 27 repeatedly adjusts the opening degree Lj of the bypass flow control valve 7*c* (step S14) to match the degree of superheating SHB_C at the outlet of the bypass pipe 23*c* with the predetermined target value SHB_C1 (<SHB_0). When the controller 27 decides that the conditions of step S13 are satisfied, the controller 27 decides that the correction of the biased distribution of the liquid refrigerant to the outdoor unit 10*b* has been confirmed, and returns to step S3. Through the foregoing control, the uneven distribution of the liquid refrigerant in the cooling operation can be corrected, and thus the reliability of the compressor can be secured.

As described thus far, Embodiment 2 provides the same advantageous effects as those of Embodiment 1, even when three or more outdoor units 10 are involved. Although the operation state quantity of the outdoor unit 10 that includes the outdoor heat exchanger 5 having the lowest heat exchange capacity is controlled in Embodiment 2 to correct the uneven liquid refrigerant distribution, it is not mandatory to control the outdoor unit 10 having the lowest heat exchange capacity. For example, the outdoor unit 10 having the second lowest heat exchange capacity may be controlled. The outdoor unit 10 to be controlled may be designated as desired depending on the design and specification of the system.

REFERENCE SIGNS LIST

1 (1*a*, 1*b*, 1*c*): compressor, 2 (2*a*, 2*b*, 2*c*): oil separator, 3 (3*a*, 3*b*, 3*c*): check valve, 4 (4*a*, 4*b*, 4*c*): four-way valve, 5 (5*a*, 5*b*, 5*c*): outdoor heat exchanger (heat source-side heat exchanger), 6 (6*a*, 6*b*, 6*c*): high-low pressure heat exchanger, 7 (7*a*, 7*b*, 7*c*): bypass flow control valve, 8 (8*a*, 8*b*, 8*c*): flow control valve, 9 (9*a*, 9*b*, 9*c*): liquid-side on-off valve, 10 (10*a*, 10*b*, 10*c*): outdoor unit, 11 (11*a*, 11*b*, 11*c*): gas-side on-off valve, 12 (12*a*, 12*b*, 12*c*): accumulator, 13 (13*a*, 13*b*, 13*c*): oil return bypass capillary, 14 (14*a*, 14*b*, 14*c*): oil return bypass solenoid valve, 15 (15*a*, 15*b*, 15*c*): first pressure sensor, 16 (16*a*, 16*b*, 16*c*): second pressure sensor, 17 (17*a*, 17*b*, 17*c*): first temperature sensor, 18 (18*a*, 18*b*, 18*c*): second temperature sensor, 19 (19*a*, 19*b*, 19*c*): third temperature sensor, 20 (20*a*, 20*b*, 20*c*): fourth temperature sensor, 21 (21*a*, 21*b*, 21*c*): fifth temperature sensor, 22 (22*a*, 22*b*, 22*c*): sixth temperature sensor, 23 (23*a*, 23*b*, 23*c*): bypass pipe, 24 (24*a*, 24*b*. 24*c*): junction, 25 (25*a*, 25*b*, 25*c*): junction, 26 (26*a*, 26*b*, 26*c*): liquid pipe, 27 (27*a*, 27*b*, 27*c*): controller, 28 (28*a*, 28*b*, 28*c*): seventh temperature sensor, 30 (30*a*, 30*b*, 30*c*): oil return bypass circuit, 31 (31*a*, 31*b*, 31*c*): heat exchange volume switching valve, 32 (32*a*, 32*b*, 32*c*): heat exchange volume switching valve, 33 (33*a*, 33*b*, 33*c*): outdoor fan, 50 (50*a*, 50*b*, 50*c*): indoor unit, 100 (100*a*, 100*b*, 100*c*): indoor heat exchanger (use-side heat exchanger), 100A: air-conditioning apparatus, 100B: air-conditioning apparatus, 101 (101*a*, 101*b*): expansion valve, 102 (102*a*, 102*b*): controller, 103 (103*a*, 103*b*): eighth temperature sensor, 104 (104*a*, 104*b*): ninth temperature sensor, 200: gas distributor, 201: liquid distributor, 202*a*: gas diverging pipe, 202*b*: gas diverging pipe, 203*a*: liquid diverging pipe, 203*b*: liquid diverging pipe, 204: gas pipe, 205: liquid pipe, 206*a*: gas branch pipe, 206*b*: gas branch pipe, 207*a*: liquid branch pipe, 207*b*: liquid branch pipe, 208: gas distributor, 209: liquid distributor, 210: gas diverging pipe, 211: gas diverging pipe, 212: liquid diverging pipe, 213: liquid diverging pipe

The invention claimed is:

1. An air-conditioning apparatus comprising:

a plurality of heat source units each including a compressor, a heat source-side heat exchanger, and an accumulator;

a use-side unit including a use-side heat exchanger and a pressure reducing device;

a bypass pipe provided in each of the plurality of heat source units and branched from a pipe between the heat source-side heat exchanger and the pressure reducing device to form a bypass to a suction side of the compressor;

a flow control valve provided in the bypass pipe;

a high-low pressure heat exchanger exchanging heat between low-pressure refrigerant and high-pressure refrigerant, the low-pressure refrigerant flowing through the bypass pipe between the flow control valve and the suction side of the compressor, the high-pressure refrigerant flowing between the heat source-side heat exchanger and the pressure reducing device; and a controller configured to decide whether liquid refrigerant is unevenly distributed among the plurality of heat source units and to identify a low capacity-side heat source unit and high capacity-side heat source unit, the low capacity-side heat source unit being one of the plurality of heat source units in which the heat source-side heat exchanger has a lower heat exchange capacity, and the high capacity-side heat source unit being another of the plurality of heat source units in which the heat source-side heat exchanger has a higher heat exchange capacity, wherein after the controller decides that the liquid refrigerant is unevenly distributed among the plurality of heat source units, the controller is configured to adjust a discharge superheating degree of the compressor in the low capacity-side heat source unit to match the lower heat exchange capacity of the heat source-side heat exchanger in the low capacity-side heat source unit with the higher heat exchange capacity of the heat source-side heat exchanger in the high capacity-side heat source unit by adjusting an outlet subcooling degree of the heat source-side heat exchanger or an outlet subcooling degree at a high-pressure outlet of the high-low pressure heat exchanger of the low capacity-side heat source unit, and wherein in a case where the heat exchange capacity of the heat source-side heat exchanger of the low capacity-side heat source unit is at an upper limit of a capacity range after the controller decides that the liquid refrigerant is unevenly distributed among the plurality of heat source units, the controller is configured to adjust an opening degree of the flow control valve of the high capacity-side heat source unit on a basis of an outlet superheating degree of the bypass pipe of the high capacity-side heat source unit.

2. The air-conditioning apparatus of claim 1, wherein the controller is configured to adjust the opening degree of the flow control valve of the high capacity-side heat source unit to match the outlet superheating degree of the bypass pipe of the high capacity-side heat source unit with a target value predetermined for a case where the liquid refrigerant is unevenly distributed, in the case where the heat exchange capacity of the heat source-side heat exchanger of the low capacity-side heat source unit is at the upper limit of the capacity range after the controller decides that the liquid refrigerant is unevenly distributed among the plurality of heat source units.

3. The air-conditioning apparatus of claim 1, wherein the controller is configured to decide that the liquid refrigerant is unevenly distributed among the plurality of heat source units, when a temperature difference between the outlet subcooling degrees of a plurality of the heat source-side heat exchangers, a temperature difference between the outlet subcooling degrees of the high-low pressure heat exchangers, or a temperature difference between the discharge superheating degrees of a plurality of the compressors, is equal to or larger than a corresponding predetermined threshold.

4. The air-conditioning apparatus of claim 1, wherein the plurality of heat source units each includes a fan supplying air to the heat source-side heat exchanger, and the controller is configured to adjust the heat exchange capacity of the heat source-side heat exchanger by adjusting at least one of an air volume of the fan and a heat exchange volume of the heat source-side heat exchanger.

5. An air-conditioning apparatus comprising:

a plurality of heat source units each including a compressor, a heat source-side heat exchanger, and an accumulator;

a use-side unit including a use-side heat exchanger and a pressure reducing device;

a bypass pipe provided in each of the plurality of heat source units and branched from a pipe between the heat source-side heat exchanger and the pressure reducing device to form a bypass to a suction side of the compressor;

a flow control valve provided in the bypass pipe;

a high-low pressure heat exchanger exchanging heat between low-pressure refrigerant and high-pressure refrigerant, the low-pressure refrigerant flowing through the bypass pipe between the flow control valve and the suction side of the compressor, the high-pressure refrigerant flowing between the heat source-side heat exchanger and the pressure reducing device; and a controller configured to decide whether liquid refrigerant is unevenly distributed among the plurality of heat source units, when the controller decides that the liquid refrigerant is unevenly distributed among the plurality of heat source units, the controller being configured to adjust an outlet subcooling degree of the heat source-side heat exchanger or an outlet subcooling degree at a high-pressure outlet of the high-low pressure heat exchanger, and a discharge superheating degree of the compressor in a low capacity-side heat source unit to match lower heat exchange capacity of the heat source-side heat exchanger in the low capacity-side heat source unit with higher heat exchange capacity of the heat source-side heat exchanger in a high capacity-side heat source unit, the low capacity-side heat source unit being one of the plurality of heat source units in which the heat source-side heat exchanger has the lower heat exchange capacity, the high capacity-side heat source unit being another of the plurality of heat source units in which the heat source-side heat exchanger has the higher heat exchange capacity, the controller being configured to adjust an opening degree of the flow control valve of the high capacity-side heat source unit on a basis of an outlet superheating degree of the bypass pipe of the high capacity-side heat source unit, in a case where the heat exchange capacity of the heat source-side heat exchanger of the low capacity-side heat source unit is at an upper limit of a capacity range when the controller decides that the liquid refrigerant is unevenly distributed among the plurality of heat source units, wherein the plurality of heat source units each includes a fan supplying air to the heat source-side heat exchanger, the heat source-side heat exchanger includes a plurality of heat exchangers, a plurality of switching valves are provided to the heat source-side heat exchanger and each control a flow rate of the refrigerant flowing to a corresponding one of the plurality of heat exchangers from the compressor, the controller is configured to adjust the heat exchange capacity of the heat source-side heat exchanger, by adjusting at least one of an air volume of the fan or by controlling the plurality of switching valves.

6. An air-conditioning apparatus comprising:

a plurality of heat source units each including a compressor, a heat source-side heat exchanger, and an accumulator;

a use-side unit including a use-side heat exchanger and a pressure reducing device;

a bypass pipe provided in each of the plurality of heat source units and branched from a pipe between the heat source-side heat exchanger and the pressure reducing device to form a bypass to a suction side of the compressor;

a flow control valve provided in the bypass pipe;

a high-low pressure heat exchanger exchanging heat between low-pressure refrigerant and high-pressure refrigerant, the low-pressure refrigerant flowing through the bypass pipe between the flow control valve and the suction side of the compressor, the high-pressure refrigerant flowing between the heat source-side heat exchanger and the pressure reducing device; and a controller configured to decide whether liquid refrigerant is unevenly distributed among the plurality of heat source units, when the controller decides that the liquid refrigerant is unevenly distributed among the plurality of heat source units, the controller being configured to adjust an outlet subcooling degree of the heat source-side heat exchanger or an outlet subcooling degree at a high-pressure outlet of the high-low pressure heat exchanger, and a discharge superheating degree of the compressor in a low capacity-side heat source unit to match lower heat exchange capacity of the heat source-side heat exchanger in the low capacity-side heat source unit with higher heat exchange capacity of the heat source-side heat exchanger in a high capacity-side heat source unit, the low capacity-side heat source unit being one of the plurality of heat source units in which the heat source-side heat exchanger has the lower heat exchange capacity, the high capacity-side heat source unit being another of the plurality of heat source units in which the heat source-side heat exchanger has the higher heat exchange capacity, and the controller is configured to adjust the opening degree of the flow control valve of the high capacity-side heat source unit to match the outlet superheating degree of the bypass pipe of the high capacity-side heat source unit with a target value predetermined for a case where the liquid refrigerant is unevenly distributed, in the case where the heat exchange capacity of the heat source-side heat exchanger of the low capacity-side heat source unit is at the upper limit of the capacity range when the controller decides that the liquid refrigerant is unevenly distributed among the plurality of heat source units.

7. An air-conditioning apparatus comprising:

a plurality of heat source units each including a compressor, a heat source-side heat exchanger, and an accumulator;

a use-side unit including a use-side heat exchanger and a pressure reducing device;

a bypass pipe provided in each of the plurality of heat source units and branched from a pipe between the heat source-side heat exchanger and the pressure reducing device to form a bypass to a suction side of the compressor;

a flow control valve provided in the bypass pipe;

a high-low pressure heat exchanger exchanging heat between low-pressure refrigerant and high-pressure refrigerant, the low-pressure refrigerant flowing through the bypass pipe between the flow control valve and the suction side of the compressor, the high-pressure refrigerant flowing between the heat source-side heat exchanger and the pressure reducing device; and a controller configured to decide whether liquid refrigerant is unevenly distributed among the plurality of heat source units, when the controller decides that the liquid refrigerant is unevenly distributed among the plurality of heat source units, the controller being configured to adjust an outlet subcooling degree at a high-pressure outlet of the high-low pressure heat exchanger, and a discharge superheating degree of the compressor in a low capacity-side heat source unit to match lower heat exchange capacity of the heat source-side heat exchanger in the low capacity-side heat source unit with higher heat exchange capacity of the heat source-side heat exchanger in a high capacity-side heat source unit, the low capacity-side heat source unit being one of the plurality of heat source units in which the heat source-side heat exchanger has the lower heat exchange capacity, the high capacity-side heat source unit being another of the plurality of heat source units in which the heat source-side heat exchanger has the higher heat exchange capacity, and the controller being configured to adjust an opening degree of the flow control valve of the high capacity-side heat source unit on a basis of an outlet superheating degree of the bypass pipe of the high capacity-side heat source unit, in a case where the heat exchange capacity of the heat source-side heat exchanger of the low capacity-side heat source unit is at an upper limit of a capacity range when the controller decides that the liquid refrigerant is unevenly distributed among the plurality of heat source units.

* * * * *